US005984324A

United States Patent [19]

Wariakois

[11] Patent Number: 5,984,324

[45] Date of Patent: Nov. 16, 1999

[54] TOURING SNOWBOARD

[75] Inventor: Mark J. Wariakois, Salt Lake City, Utah

[73] Assignee: Voile Manufacturing, Salt Lake City, Utah

[21] Appl. No.: 08/911,499

[22] Filed: Aug. 14, 1997

[51] Int. Cl.[6] ..... A63C 9/08

[52] U.S. Cl. ..... 280/14.2; 280/603; 280/633

[58] Field of Search ..... 280/14.2, 601, 280/603, 609, 607, 623, 633

[56] References Cited

U.S. PATENT DOCUMENTS

| | | | |
|---|---|---|---|
| 3,782,745 | 1/1974 | Stoveken . | |
| 4,022,491 | 5/1977 | Powell . | |
| 4,652,007 | 3/1987 | Dennis . | |
| 4,700,967 | 10/1987 | Meatto et al. . | |
| 4,728,116 | 3/1988 | Hill . | |
| 4,741,550 | 5/1988 | Dennis . | |
| 4,856,808 | 8/1989 | Longoni . | |
| 4,955,632 | 9/1990 | Giarritta et al. . | |
| 4,973,073 | 11/1990 | Raines et al. . | |
| 5,035,443 | 7/1991 | Kincheloe . | |
| 5,044,654 | 9/1991 | Meyer . | |
| 5,054,807 | 10/1991 | Fauvet . | |
| 5,069,463 | 12/1991 | Baud et al. . | |
| 5,156,644 | 10/1992 | Koehler et al. . | |
| 5,344,179 | 9/1994 | Fritschi et al. . | |
| 5,397,150 | 3/1995 | Commier et al. . | |
| 5,558,354 | 9/1996 | Lion . | |
| 5,649,722 | 7/1997 | Champlin | 280/609 |

FOREIGN PATENT DOCUMENTS

| | | | |
|---|---|---|---|
| 0 362 782 A2 | 10/1989 | European Pat. Off. . | |
| 2446-654 | 9/1980 | France | 280/601 |
| 2570-611 | 3/1986 | France | 280/601 |
| 2583-987 | 1/1987 | France | 280/603 |
| 2592-314 | 7/1987 | France | 280/607 |
| 2609-901 | 7/1988 | France | 280/607 |
| 2613-240 | 10/1988 | France | 280/607 |
| 2627097 | 8/1989 | France | 280/607 |
| 3806-061 | 9/1988 | Germany | 280/607 |
| 681509 A5 | 4/1993 | Switzerland . | |

OTHER PUBLICATIONS

Nitro Snowboards, Fritschi Swiss Binding System "Tour Snowboard Binding Instructions for Use" (4 pages).

*Primary Examiner*—Richard M. Camby

*Attorney, Agent, or Firm*—Morriss, Bateman, O'Bryant & Compagni

[57] ABSTRACT

A snowboard is disclosed which is comprised of two separable ski members, each having at least one non-linear longitudinal edge, and being adapted for conjoining together to selectively form the snowboard. The snowboard further comprises ski bindings associated with each ski member and a snowboard binding assembly which is comprised of elements associated with each ski member. Thus, boot bindings can be readily positioned between a skiing mode and a snowboarding mode. The ski bindings of the present invention are adapted for both fixed-heel and free-heel binding to accommodate conventional alpine and telemarking skiing. The snowboard bindings may, in one embodiment, be adjustable to position the feet at any desired angle to the board, and even allow the user to select which foot is oriented to the front of the board.

10 Claims, 9 Drawing Sheets

TOURING SNOWBOARD

RELATED APPLICATION

This is a continuation-in-part application of pending Ser. No. 08/581,466 filed Dec. 29, 1995, the contents of which are incorporated herein by reference.

BACKGROUND OF THE INVENTION

1. Field of the Invention

The invention relates generally to recreational equipment, such as skis and snowboards. More particularly, the invention relates to a two-piece touring snowboard or skiboard and complementary binding system.

2. Background of the Invention

Mountaineering and back country skiing often involves ascending a mountain with specialized gear, and then descending on either skis or a snowboard. During the climbing phase, and depending on terrain and conditions, it is common to use either snow shoes or skis which are adapted for a climbing mode. If skis are used, it is common to place climbing skins on each ski to allow the mountaineer to walk or ski "up" the mountain. Climbing skins are elongated pieces of material attached to the bottom of the ski which help grip the snow for traction.

While skiing, the mountaineer may typically have free-heel bindings for attaching the boots to the skis. A pair of climbing posts may also be used with the ski binding to alter the angle of the boot to the ski to facilitate steep climbs. In preparation for the descent, the mountaineer may "lock down" the heels of the boots in the bindings and descend the mountain using conventional modern alpine technique. This is referred to as "fixed-heel" skiing. Alternatively the mountaineer may ski down a slope with the heel of each boot free, thus using classic telemarking techniques. This is referred to as "free-heel" skiing. This form of multi-mode skiing has heretofore been unavailable to ski and snowboard enthusiasts alike.

SUMMARY OF THE INVENTION

In accordance with the present invention, a touring snowboard, sometimes also referred to as a "skiboard," is structured to be readily disassembled into separate ski members for selectively modifying the device between a snowboard and skis. The device is further structured with a binding system for using the device as a snowboard and another binding system for using the device as separate skis. The snowboard bindings may be fixed or may be adjustable to allow the user to place his feet at any desired angle, or at any direction, to the longitudinal axis of the board. The ski members are particularly structured to provide an outer and inner edge to facilitate turning and maneuvering, not only in the skiing mode, but in the snowboarding mode as well.

For ascent up a slope, the user may convert the snowboard to a pair of climbing skis by converting the snowboard into separate ski members, each having a free heel binding system. Climbing skins may be attached to the bottom of each ski member to facilitate the climb. For descent down a slope, the user may retain the separate ski members in a skiing mode by removing the climbing skins and either leaving the heel of the boot free (i.e., the telemarking mode) or securing the heel of the boot in the binding for use in an alpine mode.

Alternatively, the separate ski members may be joined and secured together to form a snowboard. The user may then readily remove the boot bindings from the ski binding assembly and reattach them to the snowboard binding assembly. The snowboard bindings serve to locate the user's feet in a fixed heel mode. The snowboard binding system adapts to the preferred stance or angular orientation of the user and, in one embodiment, may be adjustable to position the user's feet in either a left-foot-forward or a right-foot-forward mode. The binding assemblies of the present invention permit rapid tool-free conversion from the ski mode to the snowboard mode. The present invention also includes a unique means of marking and assembling the ski binding assemblies suitable to the user.

BRIEF DESCRIPTION OF THE DRAWINGS

In the drawings which illustrate what is currently considered to be the best mode for carrying out the invention.

DETAILED DESCRIPTION OF THE INVENTION

Mountaineering and back country skiing may take place in high altitude, remote regions where equipment failure can result in loss of life. Consequently, successful back country gear must be simple, rugged and reliable. Light weight is also highly desirable. The binding system and skiboard of the present invention meet these requirements.

Figure 1:
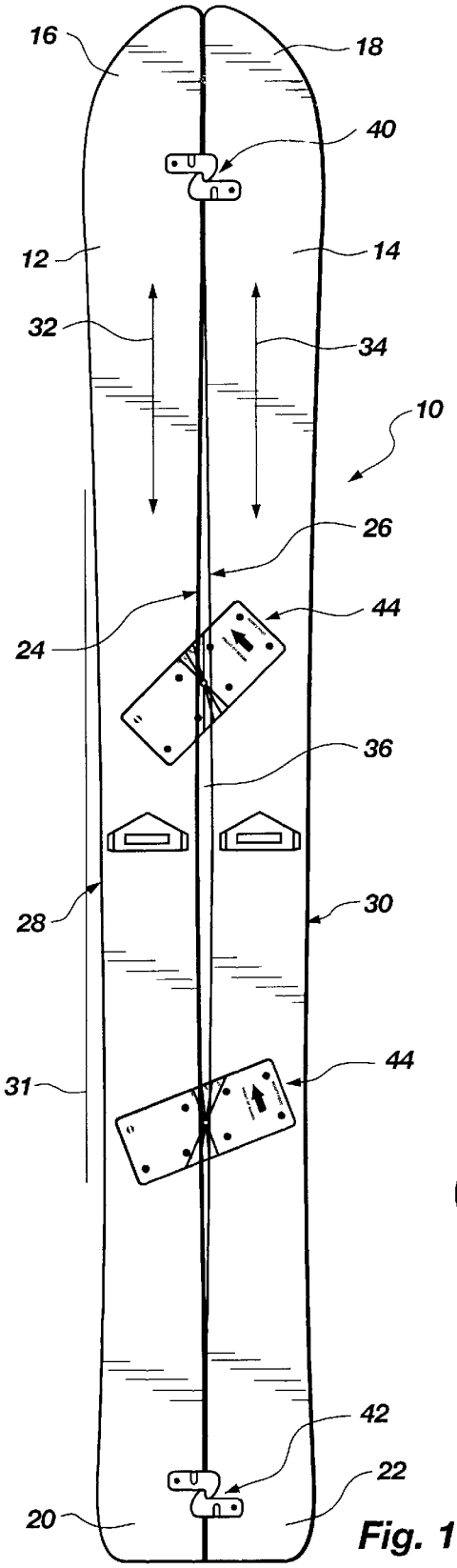
FIG. 1 is a plan view of the basic snowboard of the invention, illustrating a means for attaching the binding assembly thereto.
Figure 2:
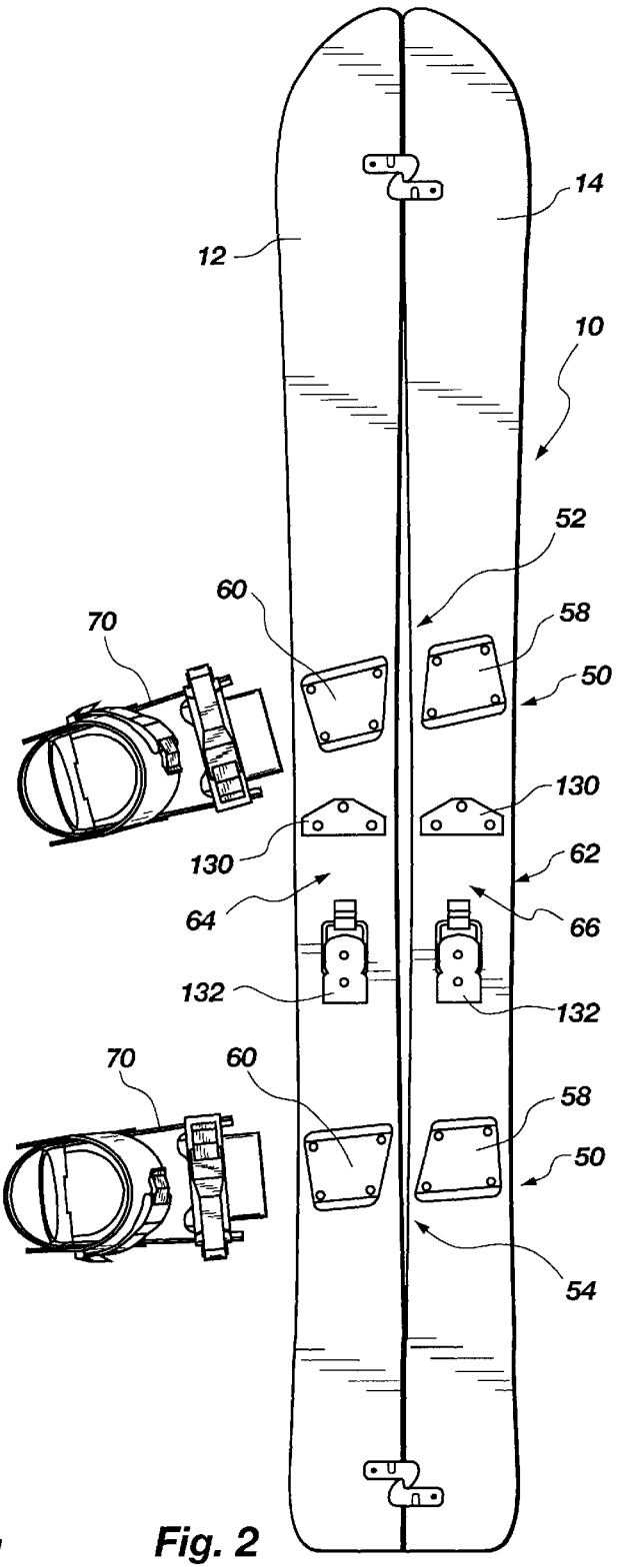
FIG. 2 is a plan view of the snowboard of the invention illustrating the placement of the binding assemblies.

FIGS. 1 and 2 illustrate the basic components of the snowboard 10 of the present invention. The snowboard 10 is comprised of a first ski member 12 and a second ski member 14 which may be selectively joined, as shown in FIG. 1, to form a snowboard 10, or selectively disjoined for use as conventional skis. FIG. 1 illustrates that the first ski member 12 and second ski member 14 are both formed with a tip 16, 18, which constitutes the front of the ski member, and a tail 20, 22, which constitutes the back of the ski member. Each ski member 12, 14 is formed with a nonlinear inside edge 24, 26, respectively, and a nonlinear outside edge 28, 30, respectively. By "nonlinear" it is meant that the inner and outer edges of each ski member do not extend along a straight line, for example line 31, extending between near the tip 16, 18 of the ski member to near the tail 20, 22 of the ski member, but curve slightly inwardly therefrom toward a longitudinal axis 32, 34 of the ski member 12, 14 and The slight curvature of the inside and outside edges of each ski member facilitate turning and maneuvering in the snow. Additionally, the curvature of the side edges of each ski member 12, 14 also provides a curved edge to the snowboard 10 thereby facilitating turning and maneuvering of the snowboard 10. Notably, when the ski members 12, 14 are secured together as the snowboard 10, the curvature of the inside edges 24, 26 forms a longitudinal gap 36 in the middle of the snowboard 10.

FIG. 1 further illustrates that the ski members 12, 14 are secured together by a suitable conjoining apparatus, such as front hooking assembly 40 and rear hooking assembly 42, each of which further comprises a set of interlocking hook members. Any suitable conjoining apparatus may be used, but the hooking assemblies 40, 42 shown are particularly suitable because they prevent "scissoring" of the ski members 12, 14 when joined together to form the snowboard 10. Still further, FIG. 1 illustrates the ski members 12, 14 prior to attachment of the ski binding assemblies, and illustrates the use, in the present invention, of a binding indicia marking device 44, which assists the user in attaching the snowboard binding assemblies, as described more fully hereinafter.

FIG. 2 illustrates a first embodiment of the snowboard 10 where a first binding assembly 50, comprising a forward set of slider blocks 52 and a rearward set of slider blocks 54, forms the snowboard binding assembly. Each set of slider blocks further comprises a toe slider blocks 58 and a heel slider block 60 for engaging a boot binding. It is notable that the toe slider blocks 58 of the forward set of slider blocks 52 and the rearward set of slider blocks 54 are both positioned on the second ski member 14, and both heel slider blocks 60 are positioned on the first ski member 12. The toe slider block 58 and heel slider block 60 of the forward set of slider blocks 52 are in alignment with each other to accept and retain a boot binding, as described more fully hereinafter, and the toe slider block 58 and heel slider blocks 60 of the rearward set of slider blocks 54 are similarly aligned with each other. A second binding assembly 62, comprising a first set of brackets 64 attached to the first ski member 12 and a second set of brackets 66 attached to the second ski member 14, forms the ski binding assembly. Boot bindings 70 for the left and right boot are shown in addition to the first and second binding assemblies 50, 56 to complete the binding assemblies of the present invention.

Figure 3:
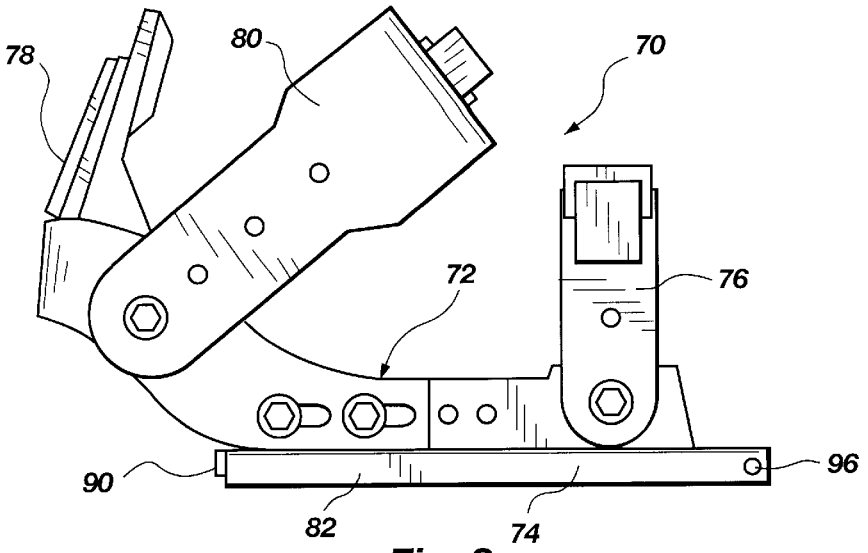
FIG. 3 is a side view of a boot binding typically used with "soft boots"
Figure 4:
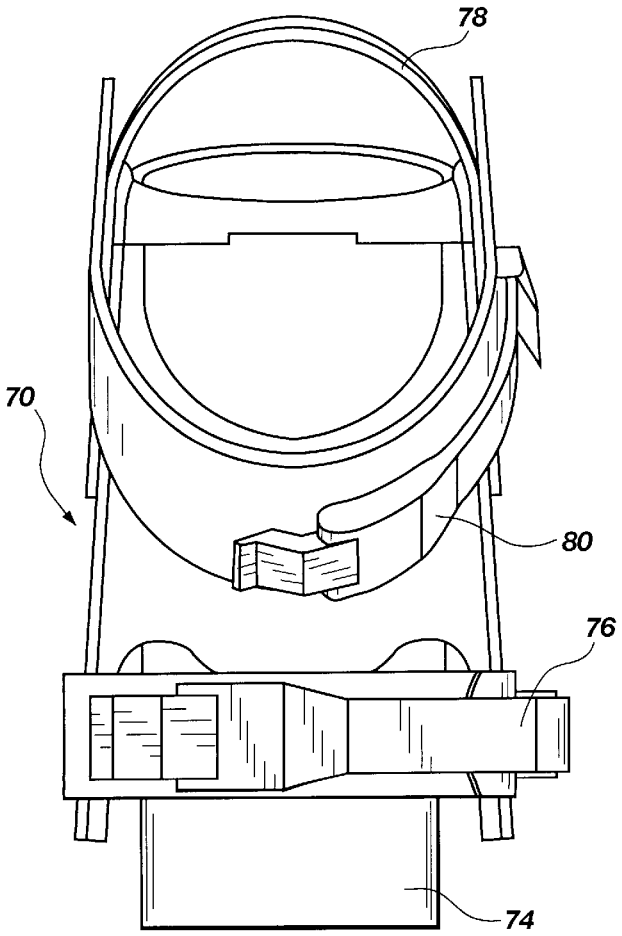
FIG. 4 is a plan view of the boot binding shown in FIG. 3.
Figure 5:
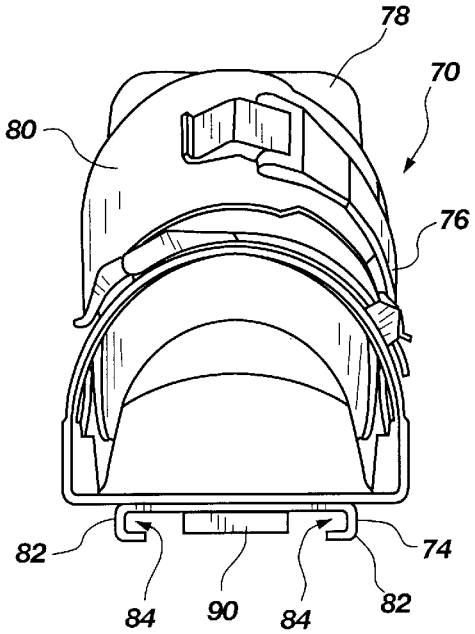
FIG. 5 is a front elevation view of the boot binding shown in FIG. 4.

FIGS. 3, 4 and 5 more fully illustrate one example of a boot binding 70 which is adaptable for use with both the ski binding assembly and the snowboard binding assembly previously described. The boot binding 70 shown in FIGS. 3–5 comprises a boot mounting assembly 72 which is bolted to a base plate 74. The boot mounting assembly 72 further comprises a toe strap 76 for engaging the toe of a boot, a heel support 78 for supporting the heel of the boot and an arch strap 80 for spanning across the arch of the boot.

Figure 6:
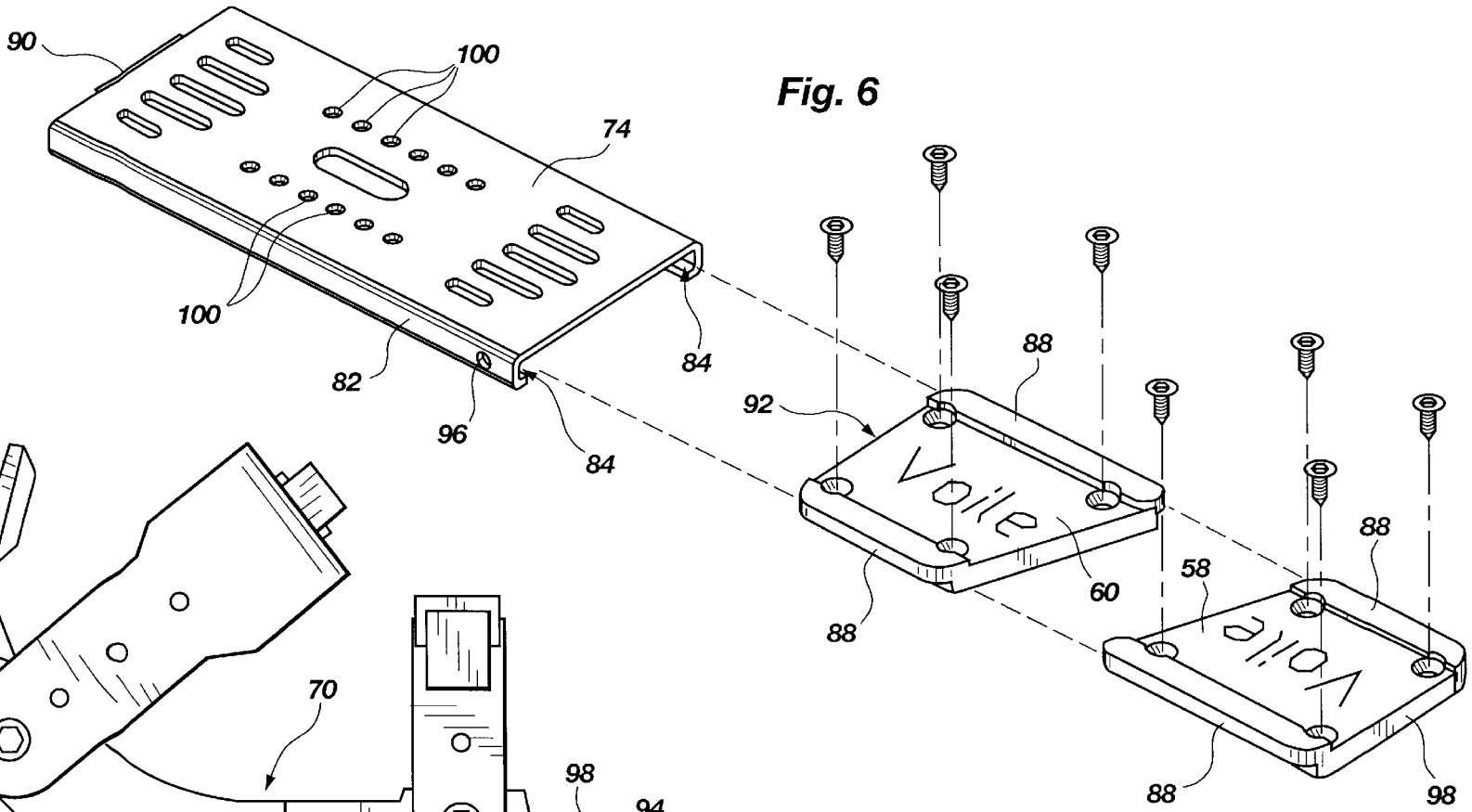
FIG. 6 is an exploded perspective view illustrating attachment of the base plate to the slider blocks of the snowboard binding.
Figure 7:
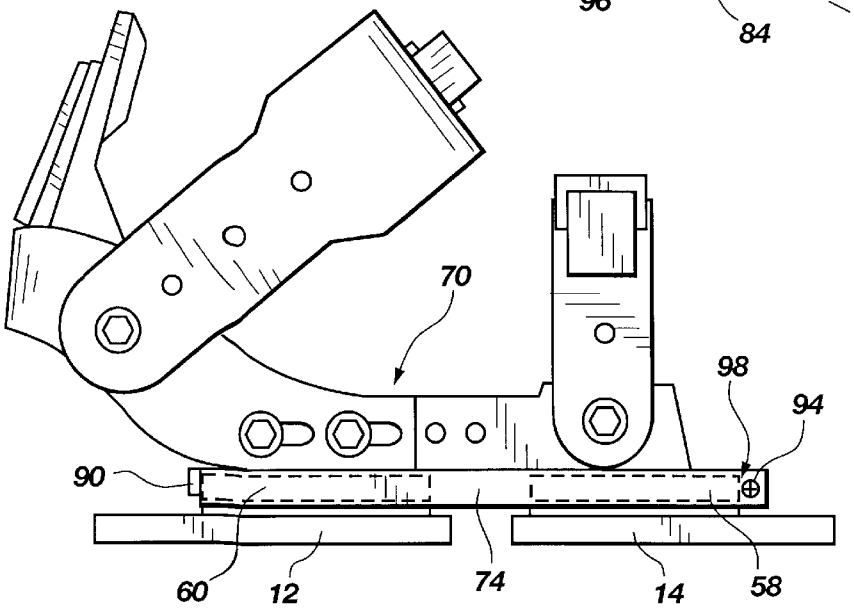
FIG. 7 is a side view in elevation illustrating the boot binding attached to the snowboard binding slider blocks.

The base plate 74, as shown more fully in FIGS. 4, 5 and 6, may be a fabricated channel section, the long edges 82 of which are inwardly curved to form a U-shaped channel 84 along both of the long sides of 82 of the base plate 74. The base plate 74 is formed with channels 84 so that the base plate 74 may be slidingly received on an aligned toe slider block 58 and heel slider block 60 of the snowboard assembly, as shown in FIG. 6. That is, each toe slider block 58 and heel slider block 60 is formed as a flattened plank having laterally extended flanges 88 sized for being slidably received in the U-shaped channels 84 of the base plate 74. Thus, as shown in FIG. 7, the base plate 74 of the boot binding 70 is slidably advanced onto both the heel 60 and the toe slider blocks 58 of the snowboard binding until the heel stop 90 (FIGS. 3, 5, 6 and 7), which is formed at the rear end of the base plate 74, comes into contact with the rear edge 92 of the heel slider blocks 60. The base plate 74 is retained in place upon the toe slider blocks 58 and heel slider blocks 60 by the positioning of a pin 94 through the apertures 96 formed near the front end of the base plate 74 (only one aperture 96 is seen in FIGS. 3 and 6, but an additional, aligned aperture 96 is formed on the opposite long side 82 of the base plate 74). The pin 94 engages the front edge 98 of the toe slider block 58 to keep the base plate 74 from sliding off the toe slider block 58 and heel slider block 60.

It may be noted that in a preferred embodiment of the base plate 74, as shown in FIG. 6, a plurality of holes 100 are formed along the length of the base plate 74 for the attachment of the boot mounting assembly 72 thereto. By providing a plurality of holes 100 as shown, the base plate 74 may accommodate any of the many varieties and makes of boot bindings manufactured by various manufacturers, thereby making the present binding widely adaptable to different boot binding styles and makes.

Figure 8B:
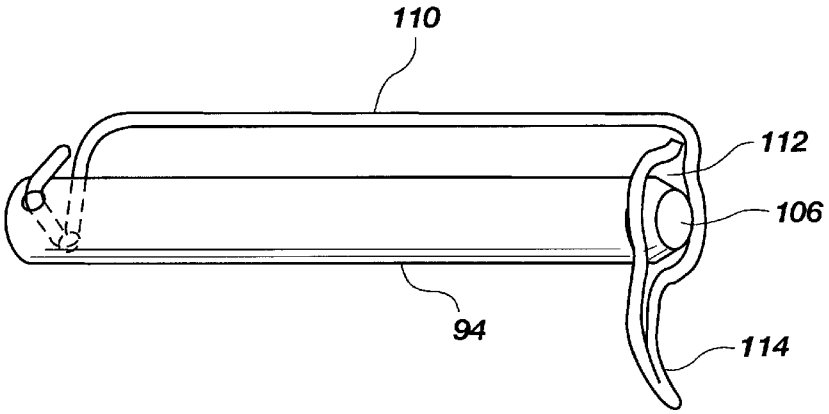
FIG. 8A and FIG. 8B illustrate an exemplary clevis pin for attaching the base plate to the binding assemblies.
Figure 8A:
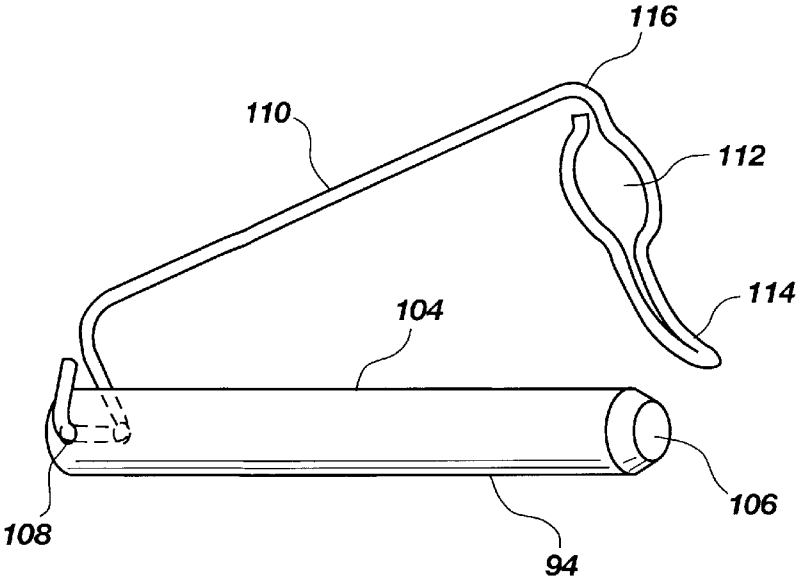

FIGS. 8A and 8B illustrate one exemplar kind of pin 94 in the binding assemblies of the present invention. The pin 94 may comprise an elongated tubular body 104 having a head 106 and a tail 108 and a clasp 110. The clasp 110 may further comprise a loop 112 formed at one end thereof to receive the head 106 of the body 104, as shown in FIG. 8B, and a catch 114 for disengaging the loop 112 from the head 106. The clasp 110 may preferably be formed with a flexible neck 116 which provides a small amount of resiliency in the clasp 100 to permit unfastening of the pin 94, as shown in FIG. 8A. Thus, for example, when the pin 94 is positioned through the apertures 96 of the base plate 74, the body 104 is positioned through the aligned apertures 96 with the head 106 of the pin 94 extending out from the opposing aperture 96. The clasp 110 is then rotated to bring the loop 112 into registration with the head 106 of the body 104 and is snapped into place. It may be preferred that the pin 94 include a tether to the binding, such as the base plate 74, to prevent loss of the pin 94 in the snow. Other pins or similar securement devices may be used in the present invention.

Figure 9:
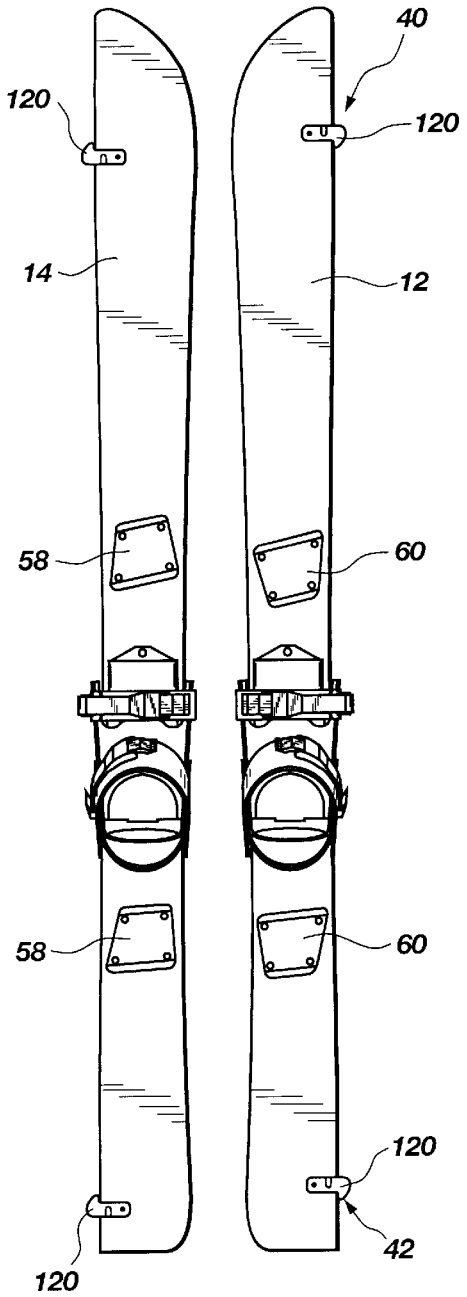
FIG. 9 is a plan view of one embodiment of the snowboard separated into the individual ski members, where the ski members are reversed.

In one embodiment of the present invention shown in FIG. 9, the first ski member 12 and the second ski member 14 may be switched or reversed so that the right side (i.e., the second ski member 14 in FIG. 1) of the snowboard 10 becomes the left ski and the left side of the snowboard 10 (i.e., the first ski member 12 in FIG. 1) becomes the right ski. The ability to reverse the ski members 12, 14 of the snowboard 10, as shown in FIG. 9, may be particularly useful if the means for joining the ski members together (e.g., the front hooking assembly 40 and rear hooking assembly 42) are not movable and must be positioned toward the outside of the ski members 12, 14 to avoid striking each other. For example, if the hooks 120 which comprise the front hooking assembly 40 and rear hooking assembly 42 are fixed in place relative to the respective ski member 12, 14 to which it is attached, disjoining the ski members 12, 14 would require the ski members 12, 14 to be reversed as shown in FIG. 9 for skiing.

Figure 11:
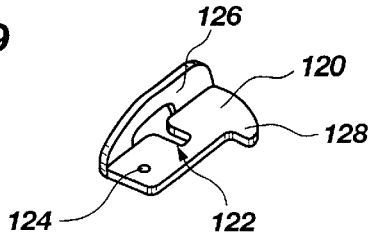
FIG. 11 is an enlarged perspective view of an exemplar hook for securing the ski members together as a snowboard.
Figure 10:
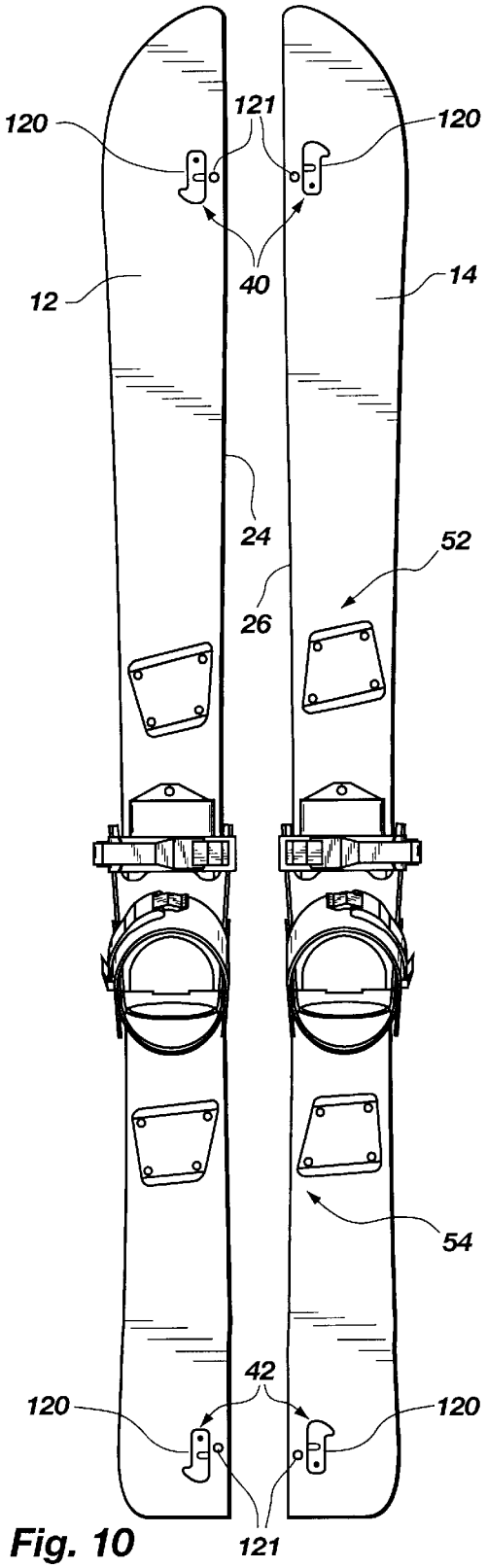
FIG. 10 is a plan view of an alternative embodiment of the snowboard where the separated ski members are not reversed.

Preferably, the means of joining the ski members 12, 14 together to form the snowboard 10 does not compromise the edges of the ski members 12, 14. Thus, for example, the hooks 120 used in the front hook assembly 40 and the rear hook assembly 42 are rotatable about a vertical axis formed through the plane of the ski member 12, 14 to enable the hook 120 to be rotated out of the way, as shown in FIG. 10. Additionally, a stop pin 121 or bolt may be secured on each ski member 12, 14 near each hook 120 of the hook assemblies to fit into a slot 122 formed in the hook 120. The stop pin 14 positioned in the slot 122 of the hook 120 prevents the hooks 120 from disengaging when interlocked. A detail of the hook 120 is shown in FIG. 11 where it can be seen that the hook 120 may be formed with a hole 124 for receiving a pin or rivet therethrough to secure the hook 120 to the top surface of the ski member to which it is attached. The hook 120 may also be formed with a thumb tab 126 positioned perpendicular to the body 128 of the hook 120 to rotate the hook 120 out of the way of the inside edge 24, 26 of the ski member 12, 14.

Figure 12:
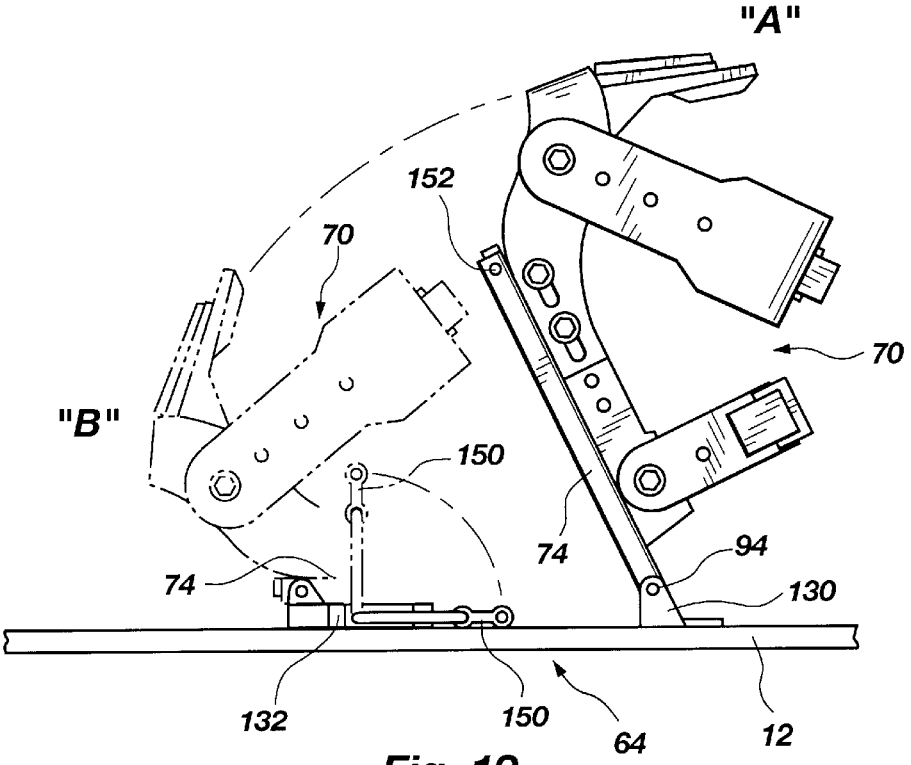
FIG. 12 is a side view in elevation showing the binding assembly in the skiing mode, and with the heel either free and elevated or fixed.

As shown in FIG. 10, when the ski members 12, 14 are disjoined to provide separate skis, the boot bindings 70 are removed from the first set of slider blocks 52 and the second set of slider blocks 54 of the snowboard binding and are reattached to the ski binding assembly 64, 66 of the respective ski members 12, 14 as shown. FIG. 12 shows one means of attaching the boot binding 70 to the ski binding assembly 64. The ski binding assembly of each ski member 12, 14 may comprise a toe bracket 130 and a heel bracket 132 (see also FIG. 2) for engagement with the boot binding 70. The base plate 74 of the boot binding 70 attaches to the toe bracket 130 by positioning a pin 94 through apertures formed in the toe bracket 130.

Figure 13:
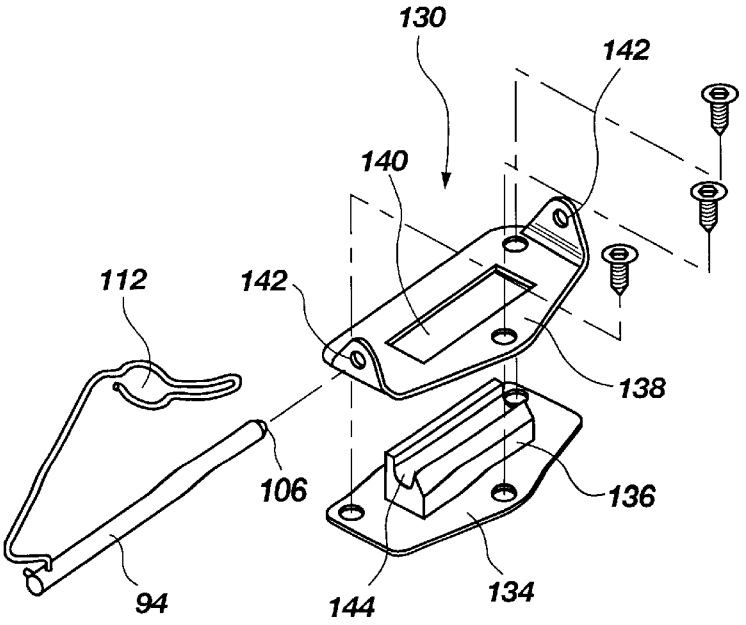
FIG. 13 is an exploded perspective view of an exemplar toe bracket of the ski binding assembly.

As more clearly shown in FIG. 13, the toe bracket 130 may further comprise a base bracket 134, having a pin cradle 136 connected thereto, and an overplate 138 having a hole 140 sized to be positioned over the pin cradle 136. The overplate 138 also includes upstanding arms 142, each arm 142 having an aperture 144 formed therethrough which aligns with a channel 144 formed in the pin cradle 136 of the base bracket 134. When the overplate 138 is assembled and secured in place over the base bracket 136, the base plate 74 of the boot binding 70 is aligned with the apertures 142 of the toe bracket 130 and the pin 94 is slidably advanced through the apertures 96 in the base plate 74, through the apertures 142 in the toe bracket 130, through the channel 144 in the pin cradle 136 and through the apertures 142 and 96 of the toe bracket 130 and base plate 74, respectively. The head 106 of the pin, protruding from the aperture 96 of the base plate 74, is engaged by the loop 112 of the pin 94.

While the front of the base plate 74 is always connected to the toe bracket 130 of the ski binding assembly 64 when in the skiing mode, the rear of the base plate 74 may or may not be attached to the heel bracket 132 to selectively provide either fixed-heel (i.e., conventional alpine skiing mode) or free-heel (i.e., telemarking ski mode) binding. Thus, as shown in FIG. 12, the heel bracket 132 may be formed with a pivotable climbing post 150 which, when pivoted upwardly to stand perpendicular to the ski member 12, forms a support upon which the rear of the base plate 74 may rest when using the skis to climb an inclined surface or slope. Alternatively, the climbing post 150 may remain flush against the upper surface of the ski member 12 to allow the base plate 74 to rotate freely about the pin 94 connection in the toe bracket 130. Still alternatively, as shown in FIG. 12, the base plate 74 may be formed with a rear aperture 152 which aligns with suitable apertures (not shown) of the heel bracket 132 to permit another pin to be positioned therethrough thereby anchoring the rear of the base plate 74 to the heel bracket 132. Other equally suitable means of releasably attaching the base plate 74 to the heel bracket 132 may be used in the invention.

Figure 14:
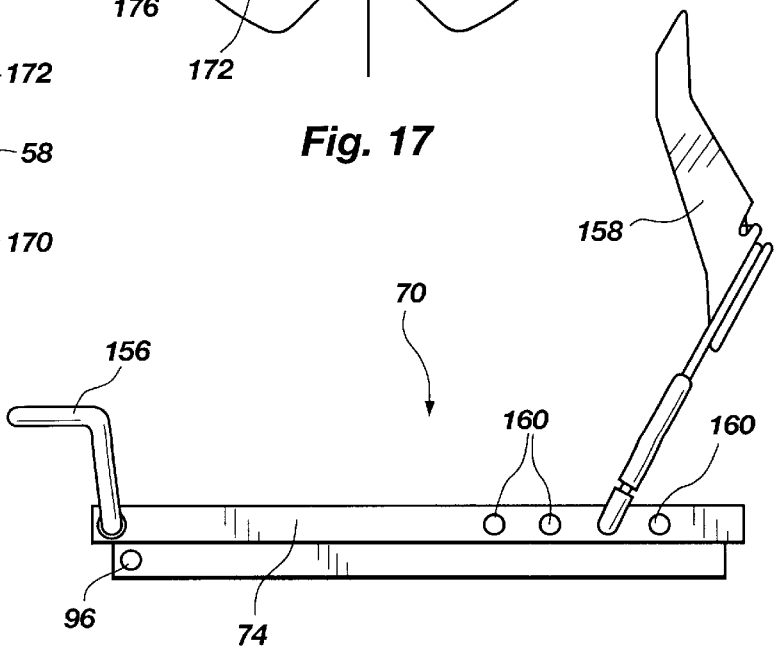
FIG. 14 is a side view in elevation of an alternative fixed-heel boot binding used for "hard shell" boots.

The boot binding 70 described thus far has been a binding of the type typically used with "soft" boots. However, boot bindings suitable for engaging "hard shell" boots may be used as well with the present invention. FIG. 14 shows a suitable hard shell boot binding which comprises a base plate 74 having a toe clip 156 for engaging the toe of a hard shell boot and an adjustable heel clip 158 for engaging the heel of a hard shell boot. The base plate 74 may preferably be formed with a plurality of holes 160 into which the heel clip 158 may be positioned to provide adjustment of the boot binding 70 to any sized boot. The base plate also has an aperture 96 formed near the front thereof to secure the base plate 74 to the toe bracket 130 as previously described.

Figure 15:
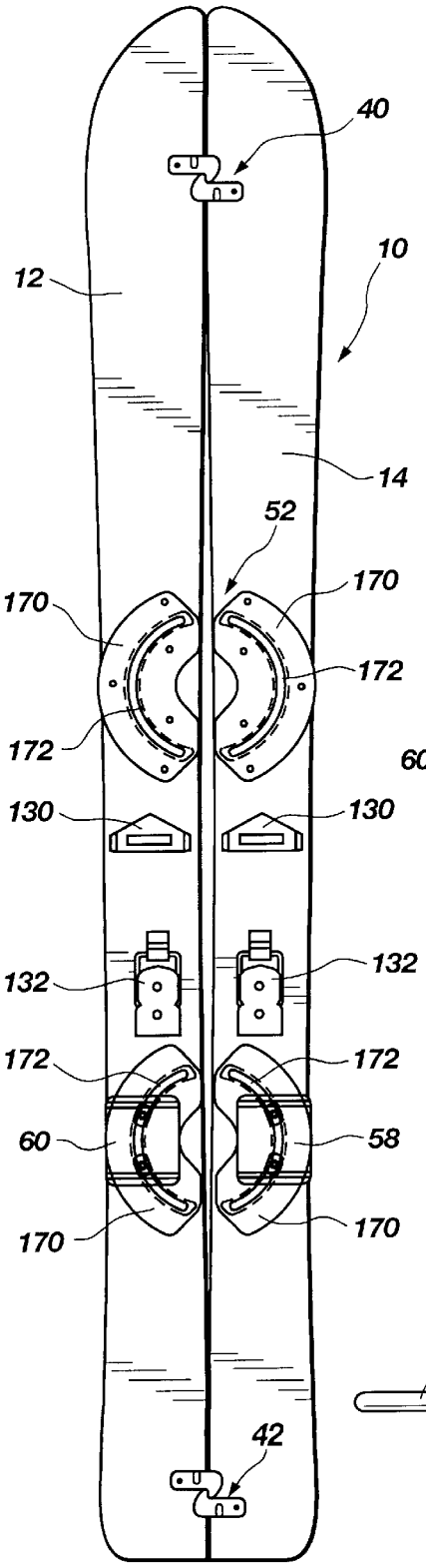
FIG. 15 is a plan view of an alternative snowboard where the snowboard binding assembly permits selective adjustability of the boot bindings.
Figure 16:
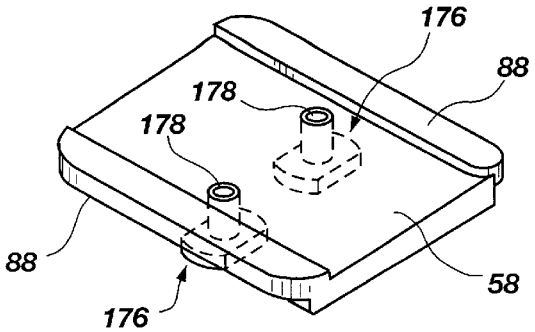
FIG. 16 is a perspective view of a toe slider blocks used in the alternative embodiment shown in FIG. 15.
Figure 17:
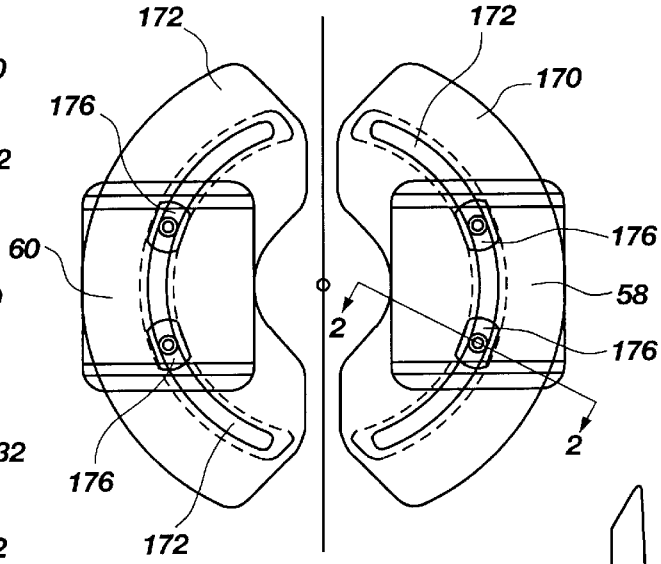
FIG. 17 is an enlarged plan view of the adjustable snowboard binding assembly shown in FIG. 15.
Figure 18:
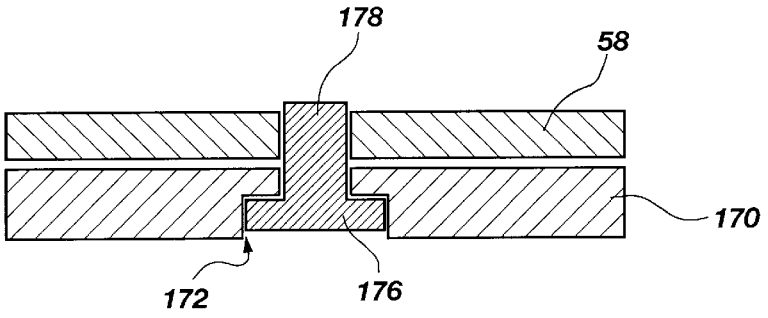
FIG. 18 is a view in cross section of the binding shown in FIG. 17 taken at line 2—2.

In another alternative embodiment of the invention shown in FIG. 15, the snowboard 10 of the present invention may include a snow binding assembly which permits selective adjustment of the toe pucks 58 and heel pucks 60 to any desired angle within a given range so that the user may customize his snowboard bindings to his own liking. Thus, as shown in FIGS. 15 and 17, the snowboard binding may include a semicircular slider block plate 170 having a semicircular channel 172 formed therein for slidably retaining either a toe slider block 58 or heel puck 60. Each toe slider block 58 and heel puck 60 may be similarly shaped and formed, as shown in FIG. 16, as a platform having laterally extending flanges 88 along opposing sides thereof. The modified slider blocks (shown in FIG. 16 as a toe slider block 58 by way of example only) include at least one (two being shown) downwardly extending bearing members 176, for example, T-nuts 178, which are sized and dimensioned for slidable movement in the semicircular channel 172 of the slider block plate 170. As seen more clearly in FIG. 18, the bearing member 176 may move in the channel 172 of the slider block plate 170 to allow the toe slider block 58 and heel slider block 60 to be selectively positioned anywhere along a generally forty-five degree angle provided by the slider block plate 170.

Figure 19:
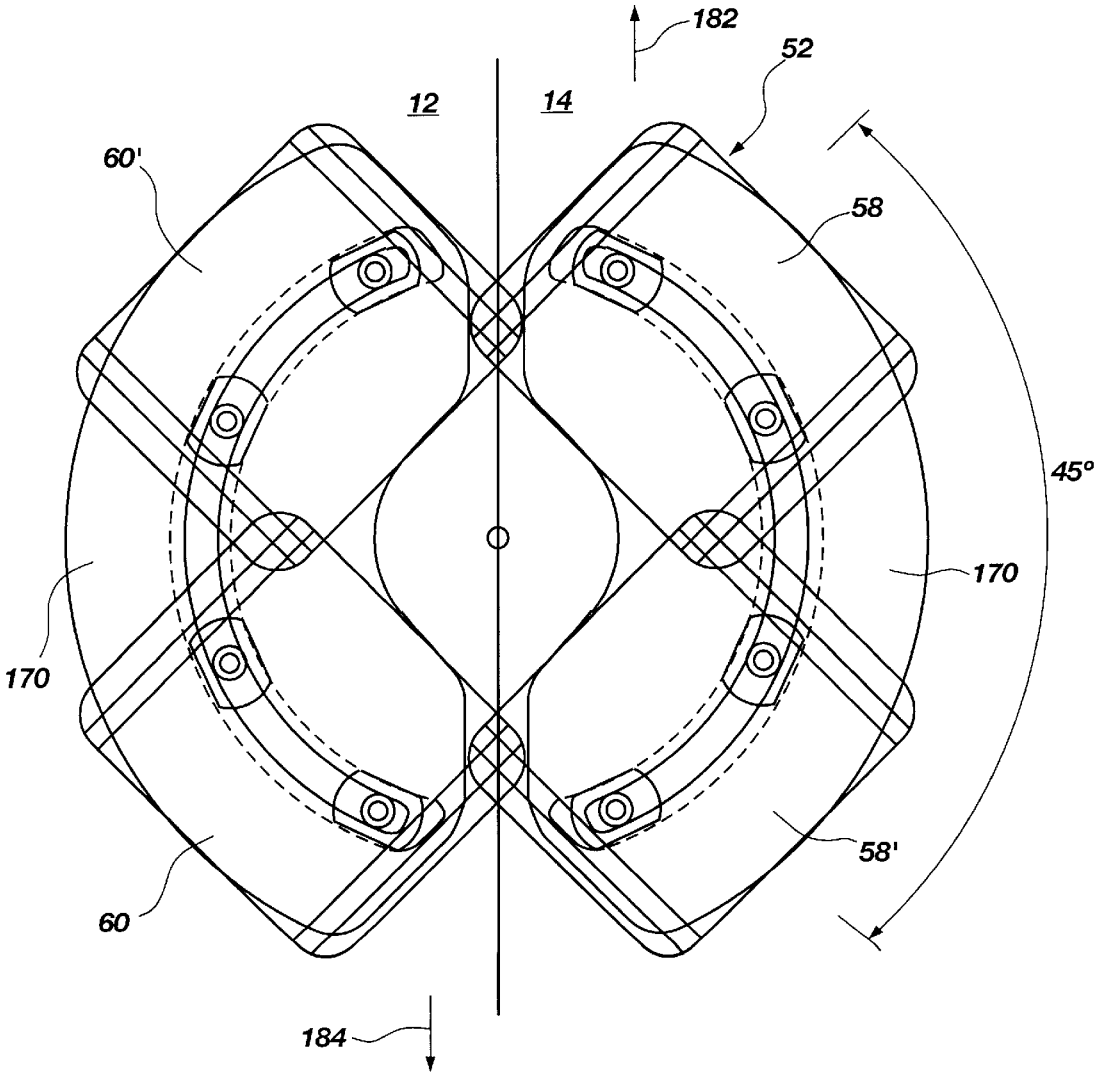
FIG. 19 is a plan view of the adjustable snowboard binding assembly illustrating the range of adjustability of the slider blocks.

The selective adjustability of the toe slider blocks 58 and heel slider blocks 60 through about a forty-five degree angle not only allows the user to position the boot bindings 70 for each foot at a desired angle to the snowboard 10, but also allows the user to mount the snowboard 10 with either the right foot or the left foot forward (i.e., closest to the tip of the snowboard 10). This principal is illustrated in FIG. 19 which shows the front slider block assembly 52 of the snowboard binding assembly. The toe slider block 58 on the second ski member 14 is positioned toward the tip of the snowboard, in the direction of arrow 182, and the aligned heel slider block 60 on the first ski member 12 is positioned toward the tail of the snowboard, in the direction of arrow 184. Therefore, when the boot binding 70 (not shown) is secured to the toe slider block 58 and heel slider block 60, the left foot is forward on the snowboard. When the toe slider block 58' is slidingly moved in the channel 172 of the slider block plate 170 forty-five degrees, and the corresponding heel puck 60' is slidingly adjusted forty-five degrees in the channel of the adjacent slider block plate 170, the heel puck 60' now becomes the toe slider block and the toe slider block 58' now becomes the heel puck so that when the boot binding 70 is attached thereto, the right foot is pointing forward toward the tip of the snowboard in the direction of arrow 182. The ability to adjust the direction and orientation of one's feet is unique to the present invention.

Figure 20:
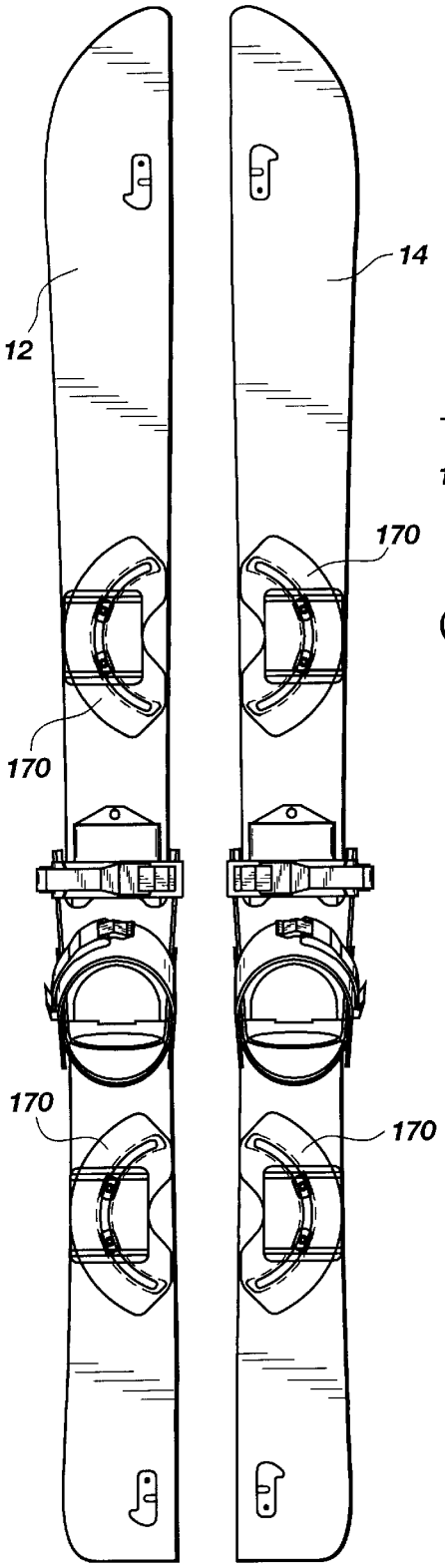
FIG. 20 is a plan view of the separated ski members of the alternative embodiment shown in FIG. 15 with the boot bindings attached to the ski binding assembly.

As previously described, the ski members 12, 14 of the alternative embodiment may be separated, as shown in FIG. 20, to provide individual skis, and the boot bindings 70 may be attached to the ski binding assemblies in the same manner as previously described. The slider block plates 170 are structured to fit on the individual ski members 12, 14 without obstructing the inside edges 24, 26 or outside edges 28, 30 of the skis.

Figure 21:
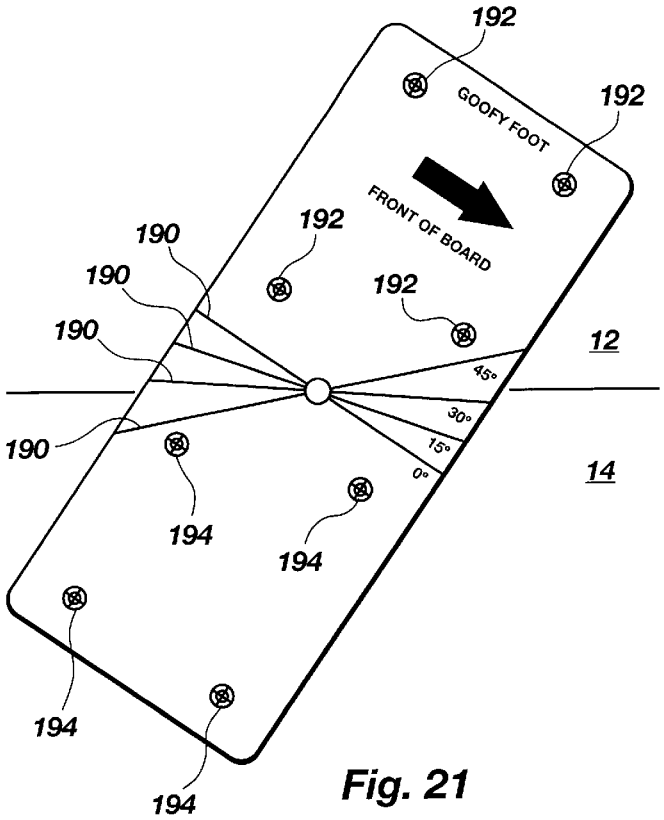
FIG. 21 is an enlarged view of the binding indicia decal used in connection with the snowboard of the invention to properly affix the snowboard binding assembly.
Figure 22:
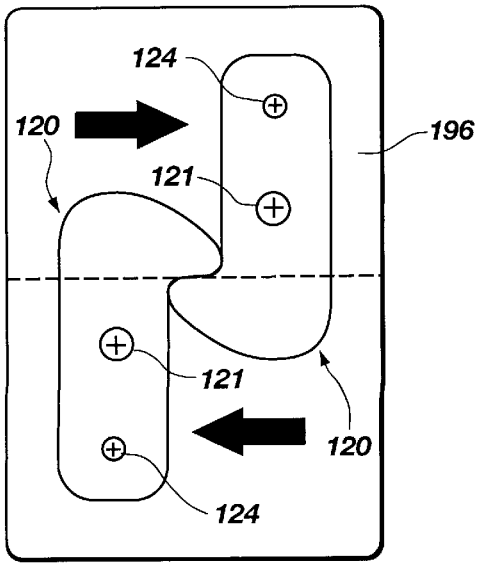
FIG. 22 is a plan view of a hook assembly indicia decal for attaching the hook assembly of the invention.

As shown in FIG. 1, the snowboard bindings as heretofore described may be secured to the ski members 12, 14, as previously described, by the user, but the attachment of the snowboard bindings to the skis is greatly facilitated by the binding attachment indicia, or marking decals 44, attached to the snowboard 10. As shown in greater detail in FIG. 21, the marking decal 44 contains at least four marking lines 190 which correspond to the angle at which the toe slider blocks 58 and heel slider blocks 60 are to be aligned and attached to the individual ski members 12, 14. As shown, the marking decal 44 is positioned between the first ski member 12 and the second ski member 14 so that the drill hole markings 192 for the toe slider block are positioned at about a forty degree angle to the longitudinal axis 32 (FIG. 1) of the first ski member 12 and the drill hole markings 194 for the heel slider block are positioned at about a forty degree angle to the longitudinal axis 34 (FIG. 1) of the second ski member 14. In a similar manner, the snowboard 10 of the present invention may be provided with a hook assembly indicia decal 196, shown in FIG. 22, which facilitates proper alignment and attachment of the hooks 120 to the ski members so that the hooks 120 interconnect properly. The decal 196 bears markings for properly positioning the stop pins 121 relative to the hooks 120. In use, the decal 196 is positioned to extend between the adjacently positioned ski members 12, 14 at an appropriate distance from the tips and tails of the ski members.

Although the invention has been described in connection with certain illustrative embodiments, it should be apparent that many modifications of the present invention may be made without departing from the scope of the invention as set forth in the claims.

What is claimed is:

1. A snowboard selectively convertible to skis comprising:

a first ski member having at least one curved longitudinal edge;

a second ski member having at least one curved longitudinal edge;

a ski binding assembly secured to said first ski member and a ski binding assembly secured to said second ski member, a snowboard binding assembly positioned to extend a boot binding between said first ski member and said second ski member, said snowboard binding having a first toe slider block and a second toe slider block carried by one of said first and second ski members and a first heel slider block and second heel slider block carried by the other of said first and second ski members, said first toe slider block being in linear alignment with said first heel slider block to receive a boot binding and said second toe slider block being in linear alignment with said second heel slider block to receive a boot binding; and conjoining apparatus for securing said first ski member to said second ski member to form a snowboard having curved longitudinal edges.

2. The snowboard of claim 1 wherein said first and second toe slider blocks are secured to one of said first and second ski members and said first and second heel slider blocks are secured to the other of said first and second ski members.

3. The snowboard of claim 1 wherein said snowboard binding further comprises a plurality of slider block plates secured to said first ski member and said second ski member to slidably retain said first and second toe slider blocks and said first and second heel slider blocks to provide adjustability to said toe and heel slider blocks.

4. A snowboard selectively convertible to skis comprising:

a first ski member having at least one curved longitudinal edge;

a second ski member having at least one curved longitudinal edge, a ski binding assembly secured to said first ski member and a ski binding assembly secured to said second ski member, a snowboard binding assembly positioned to extend a boor binding between said first ski member and said second ski member, said snowboard binding having at least one element secured to said first ski member and at least one element secured to said second ski member; and conjoining apparatus for securing said first ski member to said second ski member to form a snowboard having curved longitudinal edges, said conjoining apparatus comprising at least one hook assembly having two hooks structured to interlocking engage against each other for keeping said first ski member securely conjoined to said second ski member.

5. The snowboard of claim 4 wherein one of said interlocking hooks is pivotally secured to said first ski member and the other of said interlocking hooks is pivotally secured to said second ski member, each to be rotatable about a vertical axis.

6. A snowboard selectively convertible to skis comprising:

a first ski member having at least one curved longitudinal edge;

a second ski member having at least one curved longitudinal edge;

a ski binding assembly secured to said first ski member and a ski binding assembly secured to said second ski member;

a snowboard binding assembly positioned to extend a boot binding between said first ski member and said second ski member, said snowboard binding having at least one element secured to said first ski member and at least one element secured to said second ski member;

conjoining apparatus for securing said first ski member to said second ski meinber to form a snowboard having curved longitudinal edges; and a pair of boot bindings comprised of a boot mounting assembly and a base plate, said base plate being adapted to slidably attach to said snowboard binding assembly.

7. The snowboard of claim 6 wherein said base plate of each said boot binding is formed with two longitudinal and spaced apart sides, said longitudinal sides being curved to form U-shaped channels to slidingly receive a heel slider block and a toe slider puck of said snowboard binding assembly.

8. The snowboard of claim 7 wherein said base plate further includes at least one pair of spaced apart and aligned holes sized for receiving a pin theretlirough to lockingly engage said base plate on said toe slider block and said heel slider block of said snowboard binding assembly.

9. The snowboard of claim 8 wherein said pin is tethered to said one of said ski binding assembly, snowboard binding assembly or base plate.

10. The snowboard of claim 6 wherein said base plate is formed with a plurality of holes oriented along the longitudinal axis thereof for selectively attaching the boot mounting assembly thereto.

* * * * *

UNITED STATES PATENT AND TRADEMARK OFFICE

CERTIFICATE OF CORRECTION

PATENT NO. : 5,984,324
DATED : November 16, 1999
INVENTOR(S) : Mark J. Wariakois It is certified that error appears in the above-identified patent and that said Letters Patent is hereby corrected as shown below:

Column 2,
Line 55, delete the word "blocks" and insert the word "block"

Column 3,
Line 60, delete the second instance of the word "blocks" and insert the word "block"

Column 4,
Lines 2, 33, and 36, delete the word "blocks" and insert the word "block"
Line 32, insert the words "slider block" before the numeral 60
Line 37, delete both occurrences of the word "blocks" and insert the word "block"

Column 6,
Line 45, delete all occurrences of "pucks" and insert the words "slider blocks"
Lines 51 and 52, delete "puck" and insert "slider block"
Line 62, delete the word "block" before the numeral 58 and insert the word "blocks"
Line 63, delete "block" and insert the word "blocks"

Column 7,
Lines 17, 19, and 20, delete "puck" and insert the words "slider block"

Column 8,
Line 44, delete the word "'boor" and insert the word "boot"

Column 9,
Line 10, delete the word "meinber" and insert the word "member"

Column 10,
Line 3, delete the word "puck" and insert the word "block"

UNITED STATES PATENT AND TRADEMARK OFFICE

CERTIFICATE OF CORRECTION

PATENT NO. : 5,984,324
DATED : November 16, 1999
INVENTOR(S) : Mark J. Wariakois It is certified that error appears in the above-identified patent and that said Letters Patent is hereby corrected as shown below:

Column 10,
Line 7, delete "theretlirough" and insert the word "therethrough"

Signed and Sealed this

Nineteenth Day of March, 2002

*Attest:*

*Attesting Officer*

JAMES E. ROGAN
*Director of the United States Patent and Trademark Office*